United States Patent [19]

Imai et al.

[11] Patent Number: 4,814,141

[45] Date of Patent: Mar. 21, 1989

[54] HIGH TOUGHNESS, ULTRA-HIGH STRENGTH STEEL HAVING AN EXCELLENT STRESS CORROSION CRACKING RESISTANCE WITH A YIELD STRESS OF NOT LESS THAN 110 KGF/MM²

[75] Inventors: Yasuho Imai, Tokyo; Yoichiro Tobe; Ko Moriyama, both of Sagamihara; Seinosuke Yano, Kitakyushu; Syuzo Ueda; Seimei Karino, both of Chiba, all of Japan

[73] Assignees: Japan as Represented by Director General, Technical Research and Development Institute, Japan Defense Agency, Tokyo; Nippon Steel Corporation, Ohte; Kawasaki Steel Corporation, Kobe, all of Japan

[21] Appl. No.: 45,174

[22] Filed: Apr. 22, 1987

Related U.S. Application Data

[63] Continuation of Ser. No. 801,577, Nov. 25, 1985, abandoned.

[30] Foreign Application Priority Data

Nov. 28, 1984 [JP] Japan ..... 59-251167

[51] Int. Cl.[4] ..... C22C 38/46

[52] U.S. Cl. ..... 420/109; 420/96; 420/97

[58] Field of Search ..... 420/96, 97, 109

[56] References Cited

U.S. PATENT DOCUMENTS 3,620,717 11/1971 Sekino et al. ..... 75/124
4,152,148 5/1979 Machmeier ..... 75/128 V

FOREIGN PATENT DOCUMENTS 56-9358 1/1981 Japan ..... 75/128 V

*Primary Examiner*—Deborah Yee
*Attorney, Agent, or Firm*—Balogh, Osann, Kramer, Dvorak, Genova & Traub

[57] ABSTRACT

A high toughness, ultra high-strength steel having an excellent stress corrosion cracking resistance with a yield stress of not less than 110 kgf/mm², which comprises 0.06–0.20 wt % of C, not more than 0.35 wt % of Si, 0.05–1.0 wt % of Mn, 8–11 wt % of Ni, 0.2–2.5 wt % of Cr, 0.7–2.5 wt % of Mo, 0.05–0.2 wt % of V, 0.01–0.08 wt % of Al, not more than 0.005 wt % of N, not more than 0.003 wt % of O, provided that the value of Al (%)×N (%)×10⁴ is not more than 1.5, and the balance being substantially Fe and inevitable impurities.

2 Claims, 2 Drawing Sheets

HIGH TOUGHNESS, ULTRA-HIGH STRENGTH STEEL HAVING AN EXCELLENT STRESS CORROSION CRACKING RESISTANCE WITH A YIELD STRESS OF NOT LESS THAN 110 KGF/MM$^2$

This application is a continuation of application Ser. No. 801,577, filed Nov. 25, 1985, now abandoned.

BACKGROUND OF THE INVENTION

1. Field of the Invention

This invention relates to ultra high strength steels with a yield stress of not less than 110 kgf/mm$^2$ having excellent strength, toughness and stress corrosion cracking resistance in sea water.

2. Related Art Statement

There has recently been taken a great interest in deep sea such as submarine resources exploitation, submarine crust and geological surveys or the like. In the industry of shipbuilding, the development and construction of pressure structures such as vessel for deep sea and the like, which are related to the submarine exploitation, have been faced with interest, and therefore an effort has been made to develop building techniques inclusive of welding.

The offshore structures such as deep-sea vessel and so on must not be deformed and destroyed by pressure, and therefore the maintenance of safety is taken up as a most significant item. The material for use in these structures is required to have a high ratio of strength to weight, namely a high strength and an excellent toughness owing to the necessity of providing a spherical shell having a high structure efficiency. Additionally, in case of using these high strength materials in atmosphere and environment different from air, investigations should particularly and sufficiently be made on the stress corrosion cracking.

In order to respond to such a strong demand for materials with more safety and higher reliability, the development and quality improvement of Ni-containing low alloy steel as an ultra high strength steel have been performed. For instance, there are developed many methods of producing these steels, such as Ni-Cr-Mo-V series high strength and high toughness steel with a yield stress of not less than 100 kgf/mm$^2$ characterized by satisfying $C+\frac{1}{8}Mo+V>0.26$ and $Cr<0.8Mo$ as disclosed in Japanese Patent laid open No. 56-9,358, an Ni-Cr-Mo-V series ultra high strength steel with a yield stress of not less than 110 kgf/mm$^2$ wherein high strength and toughness are obtained at a wide cooling rate in the hardening treatment as disclosed in Japanese Patent laid open No. 57-188,655, a high toughness hardened and tempered-type Ni-containing steel treated for extremely low phosphorus and extremely low sulfur, and the like.

These methods are effective to increase the toughness. However, in consideration of service environments, it is hard to say that the resulting steels are sufficiently safe in use because no investigation is made considering the stress corrosion, for example, in sea water.

With respect to the stress corrosion cracking of the ultra high strength steel, the theory of linear fracture dynamics by B. F. Brown in U.S. NRL is accepted, whereby there is adopted a method of quantitatively determining what fracture behavior a material having some defects exhibits in corrosion environment by using a K-value at the top of the crack.

That is, a constant stress test is made with respect to a notched specimen at various levels of K-value under service environment by facilitating the occurrence of delayed fracture at the top of notch under extremely severe conditions, from which a critical value, $K_{ISCC}$ value for producing no fracture below a certain K-value is measured to a evaluate a stress corrosion cracking resistance.

SUMMARY OF THE INVENTION

The inventors have made various investigations with respect to various steels having different chemical compositions in order to develop a steel having a high strength and toughness and an excellent resistance to stress corrosion cracking in sea water or the like, and found that an objective steel can be produced by reducing impurity elements, particularly N and O contained in Ni-containing steel, and as a result the invention has been accomplished.

According to the invention, there is the provision of a high toughness, ultra high strength steel having an excellent stress corrosion cracking resistance with a yield stress of not less than 110 kgf/mm$^2$, which comprises 0.06–0.20% by weight of C, not more than 0.35% by weight of Si, 0.05–1.00% by weight of Mn, 8–11% by weight of Ni, 0.2–2.5% by weight of Cr, 0.7–2.5% by weight of Mo, 0.05–0.2% by weight of V, 0.01–0.08% by weight of Al, not more than 0.005% by weight of N, not more than 0.003% by weight of O, and if necessary, at least one of not more than 2% by weight of Cu, not more than 0.1% by weight of Nb, not more than 0.05% by weight of Ti, not more than 0.1% by weight of Zr, not more than 0.1% by weight of Ta and not more than 1% by weight of W, provided that the value of $Al(\%)\times N(\%)\times 10^4$ is not more than 1.5 and the balance being substantially Fe and inevitable impurities.

DETAILED DESCRIPTION OF THE INVENTION

Figure 1:
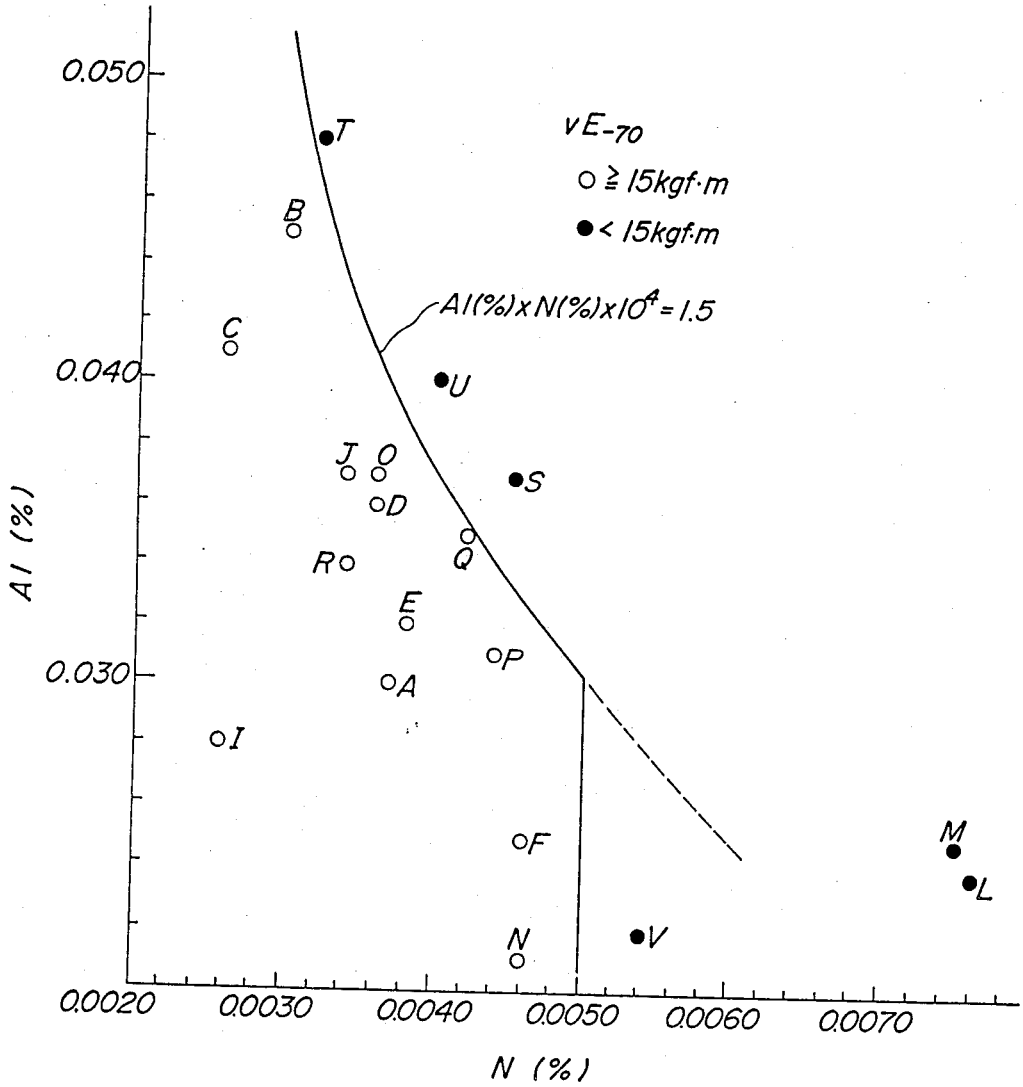
FIG. 1 is a graph showing a relation among the toughness, Al and N contents in parent metal, which represents that value of the toughness in the steel according to the invention having a value of $Al(\%)\times N(\%)\times 10^4$ of not more than 1.5 is clearly different from that of the steel having a value of $Al(\%)\times N(\%)\times 10^4$ of more than 1.5 or a content of N of more than the range defined in the claim of the invention.

The reason why the chemical composition of the steel according to the invention is limited to the above ranges will be described in detail with reference to the accompanying drawings.

C is an element required for maintaining the hardenability and strength. However, when the C content is less than 0.06%, it is impossible to maintain the strength required in the steel of the invention. While, when it exceeds 0.2%, the hardening at weld heat-affected zone becomes conspicuous to degrade the toughness and stress corrosion cracking resistance. Thus, the C content is restricted to a range of 0.06–0.2%.

Si is effective in high strengthening. However, when the Si content is high in high Ni steel, the susceptibility to temper brittleness becomes large to impair the a notch toughness. Therefore, the upper limit of the Si content is restricted to 0.35% for maintaining the strength to a certain extent and avoiding the lowering of the notch toughness.

Mn is required for maintaining the hardenability and preventing cracks in the hot working and hot tear cracks in the welding. However, when the Mn content is high in the Ni-containing steel, the susceptivity to temper brittleness is large, so that the Mn content is required to be not more than 1%. On the other hand, when the Mn content is less than 0.05%, there is no effect for the prevention of the hot tear cracks. Therefore, the Mn content is restricted to a range of 0.05–1%.

Ni acts to stabilize a retained autenite against impact stress by forming a mixed structure of lower bainite and martensite by the hardening treatment and then comparatively fast diffusing and absorbing into austenite in the tempering. For this end, the Ni content is required to be not less than 8%. On the other hand, when the Ni content exceeds 11%, the retained austenite transformed in the tempering is made unstable to degrade the toughness, and the hardness at weld heat-affected zone is increased to degrade the toughness or the stress corrosion cracking resistance. Thus, the Ni content is restricted to a range of 8–11%.

Cr is required to be not less than 0.2% for maintaining the hardenability and strength. On the other hand, when the Cr content exceeds 2.5%, the carbide extremely increases to degrade the toughness. Thus, the Cr content is restricted to a range of 0.2–2.5%.

Mo is required for maintaining the strength and preventing the temper brittleness in the Ni-containing steel. When the Mo content is less than 0.7%, the aiming strength can not be obtained. While, when it exceeds 2.5%, the coarse carbide is formed to reduce the toughness and the stress corrosion cracking resistance. Thus, the Mo content is restricted to a range of 0.7–2.5%.

V is required for forming the carbonitride in the tempering to maintain the strength. The V content is required to be not less than 0.05% for maintaining the aiming strength. On the other hand, when it exceeds 0.2%, the toughness is degraded. Thus, the V content is restricted to a range of 0.05–0.2%.

N is required to be reduced as low as possible because it largely affects the stress corrosion cracking resistance K at weld heat-affected zone and the maintenance of the toughness in the parent metal. And also, N is related to Al to exhibit a delicate effect as AlN as described later, so that the separately defined restriction is required. Additionally, in the V-containing steel according to the invention, vanadium nitride is formed to be effective on the high strengthening. However, when the N content exceeds 50 ppm, the coarse nitride is formed to degrade the toughness.

In the ultra high strength steel, O largely affects the toughness and particularly controls the value of an absorbed energy at an upper shelf of Charpy transition curve or the value of shelf energy. The greater part O in the steel forms an oxide which lowers the absorbed energy at the fracture, so that the higher the strength in the steel is, the larger the influence of O becomes. Therefore, it is desired that the O content is reduced as low as possible. When the O content is not more than 30 ppm, the toughness aiming at the invention is first obtained.

Al is bonded with N in the steel to form AlN, which contributes to the fining of the structure. However, when the addition amount of Al is excess, the coarsening of particle is reversely caused and the amount of inclusion such as $Al_2O_3$ and the like is increased which considerably impede the improvement of toughness, particularly in case of the ultra high strength increased steel. Therefore, it is natural that the proper amount of Al is present according to the kinds of the steel, but the amount of Al is within a range of 0.01–0.08% in the steel according to the invention.

On the other hand, the Al content is further restricted in connection with N as described later, which is also previously described in the explanation of N.

In this connection, the Al and N contents are controlled so that the value of $Al(\%)\times N(\%)\times 10^4$ is not more than 1.5. That is, in order to improve the toughness, it is significant not only to restrict the amount of each of Al and N as mentioned above, but also to restrict these amounts in connection with each other. As a result, it was found that the steel satisfying the relation of $Al(\%)\times N(\%)\times 10^4 \leqq 1.5$ has a good toughness as shown in FIG. 1.

This is clear from the fact that the comparative steels S, T, U and V shown in Table 1 as mentioned later have a low toughness as shown in Table 1 and FIG. 1 because the amounts of Al and N do not satisfy the above relationship though the amount of each of Al and N is within the above defined range.

Figure 2:
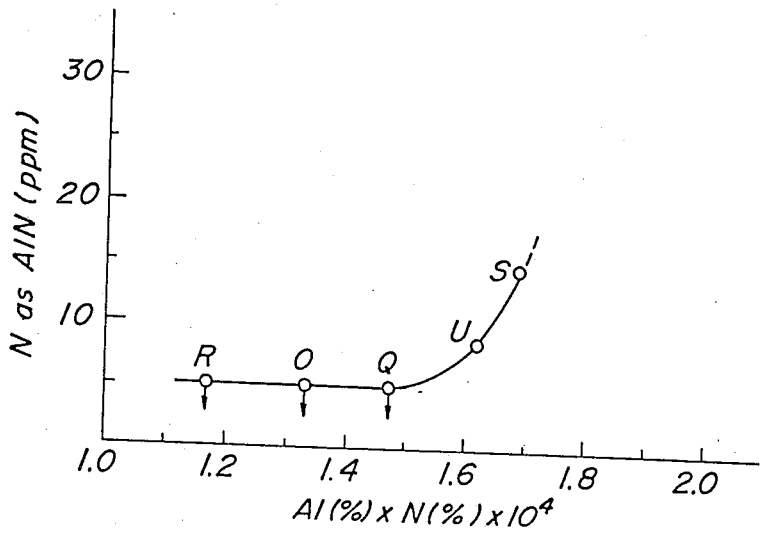
FIG. 2 is a graph showing a correlation between the value of $Al(\%)\times N(\%)\times 10^4$ and the N content as AlN under the rolled state, which represents that the amount of non-soluted coarse AlN is much after the rolling.

As further described in detail, the amount of each of Al and N in the steel having the aforementioned chemical composition is varied as shown in the steels N-V in Table 1, and then the resulting steels is subjected to a hot rolling in the usual manner. Thereafter, the amount of AlN in the hot rolled steel is analyzed to obtain results as shown in FIG. 2. As seen from FIG. 2, when the value of $Al(\%)\times N(\%)\times 10^4$ exceeds 1.5, the AlN amount increases. The most part of such an unsoluted AlN is coarsened and remains at the undissolved state even by the reheating in the hardening, which not only makes no contribution to the fining of austenitic particle but also considerably impedes the toughness, on the contrary to the fine AlN. Thus, it is required to restrict the Al and N amounts by the above relationship.

Further, the amount of the impurities such as P, S, Sb, Sn, As and the like is required to be reduced as low as possible in view of toughness and weldability.

According to the invention, steels having the similar properties can be obtained by adding the required amount of at least one element of Cu, Nb, Ti, Zr, Ta and W in addition to the aforementioned fundamental elements.

That is, not more than 2% of Cu is effective for increasing of the strength without the degradation of the toughness. However, if the addition amount exceeds the upper limit, hot tear cracks are apt to be caused at the weld zone in the welding.

Further, not more than 0.1% of Nb makes the structure of the matrix fine to exhibit the improving effect of the toughness. However, when it exceeds the upper limit, there is reversely a large danger of reducing the toughness at weld heat-affected zone.

Ti is effective for preventing the degradation of the toughness at weld heat-affected zone through the prevention of the coarsening at this zone. However, when the addition amount of Ti is too large, not only the toughness at weld heat-affected zone but also that of the parent metal are degraded, so that the upper limit is restricted to 0.05%.

Zr and Ta have a strong affinity to each of O, N and S. Therefore, when they are added in a small amount, they are effective as a deoxidizing agent, denitrifying agent or desulfurizing agent. However, when the amount of each of Zr and Ta exceeds 0.1%, the compound of each element is dispersed in the steel to degrade the toughness of the parent metal.

W has a large action of strengthening the parent metal by soluting therein and is effective for enhancing the hardenability to improve the temper resistance. However, when it exceeds 1%, the coarse carbide is formed to degrade the toughness likewise Mo. Thus, the upper limit is restricted to 1%.

The following example is given in illustration of the invention and is not intended as limitation thereof.

Figure 3:
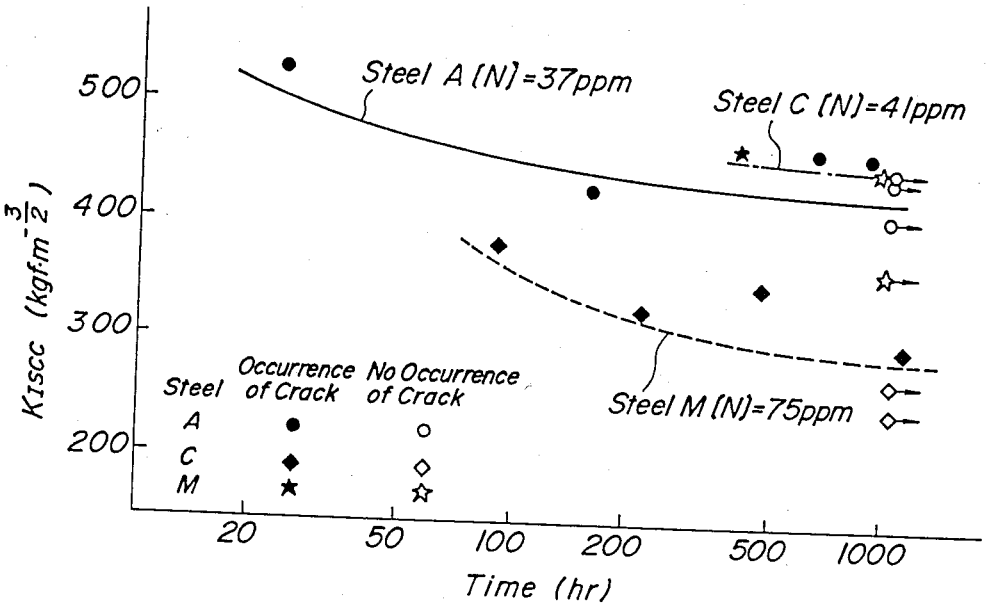
FIG. 3 is a graph showing a comparison of test results of $K_{ISCC}$ value at weld heat-affected zone obtained from three different steels, which represents that the $K_{ISCC}$ values of steels A and C are remarkably improved as compared with that of steel M having a larger amount of N.

Each of steels having a chemical composition as shown in Table 1 was manufactured, subjected to a hot working, hot-rolled to a thickness of 15–40 mm, and then subjected to hardening and tempering treatments. Thereafter, the mechanical properties of the resulting parent metal and the values of $K_{ISCC}$ in the parent metal and at weld heat-affected zone were examined. The welding was performed at a heat input of 25 KJ/cm by TIG welding. The thus obtained mechanical properties are shown in the following Table 2. Further, the test results of $K_{ISCC}$ value in some typical examples obtained by using a CT specimen of ASME E399 in 3.5% artificial sea water are shown in FIG. 3.

TABLE 1

| Steel | A | B | C | D | E | F | G | H |
|---|---|---|---|---|---|---|---|---|
| C | 0.11 | 0.11 | 0.09 | 0.12 | 0.11 | 0.12 | 0.09 | 0.13 |
| Si | Tr | 0.05 | 0.06 | 0.02 | 0.007 | 0.05 | 0.04 | 0.03 |
| Mn | 0.45 | 0.52 | 0.51 | 0.50 | 0.46 | 0.49 | 0.46 | 0.48 |
| P | 0.002 | 0.002 | 0.011 | 0.003 | 0.003 | 0.005 | 0.006 | 0.002 |
| S | 0.001 | 0.001 | 0.0004 | 0.002 | 0.001 | 0.002 | 0.002 | 0.001 |
| Ni | 9.93 | 9.37 | 9.57 | 8.36 | 10.12 | 8.79 | 9.12 | 8.56 |
| Cr | 1.00 | 0.52 | 0.51 | 0.57 | 0.98 | 0.57 | 0.51 | 0.58 |
| Mo | 0.98 | 1.21 | 0.37 | 1.01 | 1.02 | 1.22 | 0.94 | 0.97 |
| V | 0.10 | 0.10 | 0.11 | 0.10 | 0.10 | 0.10 | 0.10 | 0.10 |
| Cu | — | — | — | 0.003 | — | — | 1.05 | — |
| Nb | — | — | — | — | — | — | — | — |
| Ti | — | — | — | — | — | — | — | 0.008 |
| Ta | — | — | — | — | — | — | — | — |
| W | — | — | — | — | — | — | — | — |
| Al | 0.030 | 0.045 | 0.026 | 0.036 | 0.032 | 0.025 | 0.015 | 0.018 |
| N | 0.0037 | 0.0030 | 0.0041 | 0.0036 | 0.0038 | 0.0046 | 0.0029 | 0.0030 |
| O | 0.0019 | 0.0011 | 0.0015 | 0.0015 | 0.0018 | 0.0018 | 0.0014 | 0.0012 |
| Al × N × $10^4$ | 1.110 | 1.350 | 1.066 | 1.296 | 1.716 | 1.150 | 0.435 | 0.540 |
| Remarks | Invention steel | Invention steel | Invention steel | Invention steel | Invention steel | Invention steel | Invention steel | Invention steel |

| Steel | I | J | K | L | M | N | O |
|---|---|---|---|---|---|---|---|
| C | 0.11 | 0.10 | 0.11 | 0.11 | 0.10 | 0.08 | 0.09 |
| Si | 0.03 | 0.05 | 0.05 | 0.04 | 0.05 | 0.009 | 0.014 |
| Mn | 0.50 | 0.54 | 0.49 | 0.52 | 0.51 | 0.55 | 0.46 |
| P | 0.003 | 0.004 | 0.010 | 0.006 | 0.008 | 0.005 | 0.004 |
| S | 0.001 | 0.003 | <0.003 | 0.001 | 0.002 | 0.001 | 0.001 |
| Ni | 8.92 | 8.73 | 8.81 | 8.05 | 9.15 | 10.1 | 10.3 |
| Cr | 0.52 | 0.49 | 0.52 | 0.56 | 0.53 | 1.01 | 0.99 |
| Mo | 0.95 | 1.00 | 1.00 | 0.92 | 1.22 | 1.05 | 1.01 |
| V | 0.06 | 0.10 | 0.10 | 0.10 | 0.12 | 0.12 | 0.098 |
| Cu | 0.35 | — | 0.25 | 0.02 | — | — | — |
| Nb | 0.015 | — | 0.038 | — | — | — | — |
| Ti | — | — | — | — | — | — | — |
| Ta | — | 0.03 | — | — | — | — | — |
| W | — | — | 0.45 | — | — | — | — |
| Al | 0.028 | 0.037 | 0.033 | 0.024 | 0.025 | 0.021 | 0.037 |
| N | 0.0026 | 0.0032 | 0.0017 | 0.0076 | 0.0075 | 0.0046 | 0.0036 |
| O | 0.0016 | 0.0014 | 0.0017 | 0.0022 | 0.0027 | 0.0019 | 0.0021 |
| Al × N × $10^4$ | 0.728 | 1.184 | 0.561 | 1.824 | 1.875 | 0.966 | 1.332 |
| Remarks | Invention steel | Invention steel | Invention steel | Comparative steel | Comparative steel | Invention steel | Invention steel |

| Steel | P | Q | S | T | U | V |
|---|---|---|---|---|---|---|
| C | 0.11 | 0.11 | 0.11 | 0.11 | 0.10 | 0.09 |
| Si | 0.012 | 0.012 | 0.010 | 0.007 | 0.011 | 0.012 |
| Mn | 0.44 | 0.45 | 0.44 | 0.43 | 0.45 | 0.50 |
| P | 0.003 | 0.006 | 0.004 | 0.004 | 0.003 | 0.005 |
| S | 0.002 | 0.001 | 0.001 | 0.001 | 0.002 | 0.001 |
| Ni | 9.8 | 10.0 | 10.0 | 9.9 | 10.2 | 10.1 |
| Cr | 1.00 | 0.93 | 0.89 | 0.99 | 0.98 | 0.98 |
| Mo | 0.96 | 0.95 | 0.98 | 0.96 | 0.98 | 0.96 |
| V | 0.10 | 0.097 | 0.10 | 0.095 | 0.097 | 0.10 |
| Cu | — | — | — | — | — | — |
| Nb | — | — | — | — | — | — |
| Ti | — | — | — | — | — | — |
| Ta | — | — | — | — | — | — |

TABLE 1-continued

| | | | | | | |
|---|---|---|---|---|---|---|
| W | — | — | — | — | — | — |
| Al | 0.031 | 0.035 | 0.037 | 0.032 | 0.040 | 0.022 |
| N | 0.0044 | 0.0042 | 0.0045 | 0.0048 | 0.0040 | 0.0054 |
| O | 0.0019 | 0.0022 | 0.0020 | 0.0018 | 0.0022 | 0.0020 |
| Al × N × $10^4$ | 1.364 | 1.470 | 1.665 | 1.536 | 1.600 | 1.188 |
| Remarks | Invention steel | Invention steel | Comparative steel | Comparative steel | Comparative steel | Comparative steel |

TABLE 2

| Steel | Thickness (mm) | Tensile test of parent metal 0.2% P.S. ($kgf/mm^2$) | T.S. ($kgf/mm^2$) | El (%) | R.A. (%) | Impact test of parent metal vE-70 (kgf · m) | $K_{ISCC}$ ($kgf \cdot mm^{-3/2}$) parent metal | weld heat-affected zone |
|---|---|---|---|---|---|---|---|---|
| A | 40 | 113 | 120 | 23 | — | 20.2 | >580 | 420 |
| B | 40 | 112 | 126 | 24 | — | 26.8 | >520 | 400 |
| C | 40 | 113 | 124 | 22 | — | 24.2 | >524 | 440 |
| D | 30 | 111 | 120 | 23 | — | 21.5 | — | 380 |
| E | 40 | 114 | 121 | 23 | — | 23.4 | >510 | 410 |
| F | 27 | 114 | 122 | 22 | — | 18.5 | — | 320 |
| G | 27 | 112 | 124 | 24 | — | 21.4 | — | 390 |
| H | 27 | 112 | 123 | 24 | — | 20.8 | — | 390 |
| I | 27 | 116 | 128 | 21 | — | 20.2 | — | 320 |
| J | 28 | 112 | 123 | 23 | — | 26.1 | 620 | 380 |
| K | 15 | 115 | 120 | 26 | — | 21.1 | >600 | 350 |
| L | 27 | 113 | 125 | 24 | — | 10.8 | — | 252 |
| M | 40 | 112 | 126 | 22 | — | 15.7 | 520 | 286 |
| N | 40 | 112 | 119 | 24 | 78 | 26.8 | — | — |
| O | 40 | 111 | 117 | 24 | 78 | 27.5 | — | — |
| P | 40 | 113 | 120 | 26 | 78 | 24.5 | — | — |
| Q | 40 | 115 | 121 | 24 | 75 | 20.8 | — | — |
| S | 40 | 118 | 124 | 20 | 71 | 10.6 | — | — |
| T | 40 | 119 | 124 | 20 | 70 | 13.2 | — | — |
| U | 40 | 115 | 121 | 22 | 72 | 12.5 | — | — |
| V | 40 | 113 | 120 | 23 | 74 | 12.2 | — | — |

From these results, it is understood that the N content is required to be reduced to not more than 50 ppm in order to obtain a high $K_{ISCC}$ value at weld heat-affected zone.

The reason why the $K_{ISCC}$ value at weld heat-affected zone increases by reducing the N content as mentioned above is as follows. That is, considering the heat history at weld heat-affected zone, the multilayer welding is used when the steel according to the invention is put into practical use. In this case, the weld heat-affected zone is subjected to a repeated heat affection by subsequent welding pass, whereby the precipitation and solid solution of VN and the like are repeated. However, when the N content is more than 50 ppm, the precipitates increase and also the hardening affected by weld heat is accelerated. While when the N content is lower, the finely dispersed VN little affects the $K_{ISCC}$ value, but as the N content increases, the amount of the precipitate increases and the coarsening becomes conspicuous to lower the $K_{ISCC}$ value. Therefore, the upper limit of N content is restricted to not more than 50ppm.

The manufacture of the steel according to the invention will be described below.

The steel material having a given chemical composition according to the invention is melted by means of a melting furnace such as converter, electric furnace or the like, which is subjected to a continuous casting process, an ingot molding process, a blooming process or the like to produce a slab. The thus produced slab is reheated to a temperature of not less than $Ac_3$ transformation point and rolled under such a condition that the finish rolling temperature is within an austenite forming range. Further, the thus rolled sheet is subjected to a treatment of heating at a temperature of not less than $Ac_3$ transformation point and then hardening repeatedly one or two times, and then heated at a temperature of not more than $Ac_1$ transformation point and tempered.

The steel according to the invention has the following characteristics (1) and (2):

(1) Ultra high strength steel having 0.2% P.S. of not less than 110 $kgf/mm^2$ at room temperature.

(2) Steel having a very good $K_{ISCC}$ value at weld heat-affected zone by reducing the N content.

What is claimed is:

1. A high toughness, ultra high strength steel used in a deep-sea environment having a yield strength of not less than 110 $kgf/mm^2$, a Charpy V-notch absorbed energy at −70° C. of not less than 10 kgf.m and a stress corrosion cracking resistance ($K_{ISCC}$) of not less than 500 kgf $mm^{-3/2}$ at parent metal and not less than 350 kgf $mm^{-3/2}$ at weld heat-affected zone, consisting of 0.06–0.20% by weight of C, not more than 0.35% by weight of Si, 0.05–1.00% by weight of Mn, 9.6–11% by weight of Ni, 0.2–1.5% by weight of Cr, 0.7–2.5% by weight of Mo, 0.05–0.2% by weight of V, 0.01–0.08% by weight of Al, not more than 0.005% by weight of N, not more than 0.003% by weight of O, provided that the value of Al(%)×N(%)×$10^4$ is not more than 1.5, and the balance being substantially Fe and inevitable impurities.

2. A high toughness, ultra high strength steel used in a deep-sea environment having a yield strength of not less than 110 $kgf/mm^2$, a Charpy V-notch absorbed energy at −70° C. of not less than 10 kgf.m and a stress corrosion cracking resistance ($K_{ISCC}$) of not less than 500 kgf $mm^{-3/2}$ at parent metal and not less than 350 kgf $mm^{-3/2}$ at weld heat-affected zone, consisting of 0.06–0.20% by weight of C, not more than 0.35% by weight of Si, 0.05–1.00% by weight of Mn, 9.6–11% by weight of Ni, 0.2–1.5% by weight of Cr, 0.7–2.5% by weight of Mo, 0.05–0.2% by weight of V, 0.01–0.08% by weight of Al, not more than 0.005% by weight of N, not more than 0.003% by weight of O, and at least one element of not more than 2% by weight of Cu, not more than 0.1% by weight of Nb, not more than 0.05% by weight of Ti, not more than 0.1% by weight of Zr, not more than 0.1% by weight of Ta and not more than 1% by weight of W, provided that the value of $Al(\%) \times N(\%) \times 10^4$ is not more than 1.5, and the balance being substantially Fe and inevitable impurities.

* * * * *